US006107018A

United States Patent [19]

Mydlarz et al.

[11] Patent Number: 6,107,018

[45] Date of Patent: Aug. 22, 2000

[54] HIGH CHLORIDE EMULSIONS DOPED WITH COMBINATION OF METAL COMPLEXES

[75] Inventors: Jerzy Z. Mydlarz, Fairport; Eric L. Bell, Webster; Michael S. Graham, Leroy, all of N.Y.

[73] Assignee: Eastman Kodak Company, Rochester, N.Y.

[21] Appl. No.: 09/250,200

[22] Filed: Feb. 16, 1999

[51] Int. Cl.[7] ..... G03C 1/035; G03C 1/09; G03C 1/047; G03C 5/08

[52] U.S. Cl. ..... 430/567; 430/604; 430/605; 430/642; 430/944; 430/945

[58] Field of Search ..... 430/605, 567, 430/604, 642, 944, 945

[56] References Cited

U.S. PATENT DOCUMENTS

| | | | |
|---|---|---|---|
| 4,828,962 | 5/1989 | Grzeskowiak et al. | 430/230 |
| 4,945,035 | 7/1990 | Keevert, Jr. et al. | 430/567 |
| 5,153,110 | 10/1992 | Kawai et al. | 430/375 |
| 5,219,722 | 6/1993 | Tanaka et al. | 430/574 |
| 5,227,286 | 7/1993 | Kuno et al. | 430/539 |
| 5,229,263 | 7/1993 | Yoshida et al. | 430/600 |
| 5,360,712 | 11/1994 | Olm et al. | 430/567 |
| 5,451,490 | 9/1995 | Budz et al. | 430/363 |
| 5,457,021 | 10/1995 | Olm et al. | 430/567 |
| 5,462,849 | 10/1995 | Kuromoto et al. | 430/567 |
| 5,470,771 | 11/1995 | Fujii et al. | 437/43 |
| 5,474,888 | 12/1995 | Bell | 430/567 |
| 5,494,789 | 2/1996 | Daubendiek et al. | 430/567 |
| 5,500,335 | 3/1996 | Bell | 430/567 |
| 5,503,970 | 4/1996 | Olm et al. | 430/567 |
| 5,503,971 | 4/1996 | Daubendiek et al. | 430/567 |
| 5,783,373 | 7/1998 | Mydlarz et al. | 430/604 |
| 5,783,378 | 7/1998 | Mydlarz et al. | 430/567 |
| 5,902,721 | 5/1999 | Becher et al. | 430/541 |

FOREIGN PATENT DOCUMENTS

| | | | |
|---|---|---|---|
| 0 244 184 | 11/1987 | European Pat. Off. | G03C 1/06 |
| 0 405 938 A2 | 1/1991 | European Pat. Off. | G03C 1/035 |
| 0 476 602 A1 | 3/1992 | European Pat. Off. | G03C 1/09 |
| 0 488 601 A1 | 6/1992 | European Pat. Off. | G03C 1/09 |
| 0 488 737 A1 | 6/1992 | European Pat. Off. | G03C 1/09 |
| 0 513 748 A1 | 11/1992 | European Pat. Off. | G03C 7/392 |
| 0 514 675 A1 | 11/1992 | European Pat. Off. | G03C 1/09 |

*Primary Examiner*—Mark F. Huff
*Attorney, Agent, or Firm*—Andrew J. Anderson

[57] ABSTRACT

A radiation-sensitive emulsion is disclosed comprised of silver halide grains (a) containing greater than 50 mole percent chloride, based on silver, (b) having greater than 50 percent of their surface area provided by {100} crystal faces, and (c) having a central portion accounting for from 95 to 99 percent of total silver and containing two dopants selected to satisfy each of the following class requirements: (i) a hexacoordination metal complex which satisfies the formula (I)

$$[ML_6]^n$$

wherein n is zero, −1, −2, −3 or −4; M is a filled frontier orbital polyvalent metal ion, other than iridium; and $L_6$ represents bridging ligands which can be independently selected, provided that least four of the ligands are anionic ligands, and at least one of the ligands is a cyano ligand or a ligand more electronegative than a cyano ligand; and (ii) an iridium coordination complex containing a thiazole or substituted thiazole ligand. A photographic recording element comprising a support and at least one light sensitive silver halide emulsion layer comprising silver halide grains as described above is also disclosed, as well as an electronic printing method which comprises subjecting a radiation sensitive silver halide emulsion layer of a recording element to actinic radiation of at least $10^{-4}$ ergs/cm$^2$ for up to 100$\mu$ seconds duration in a pixel-by-pixel mode, wherein the silver halide emulsion layer is comprised of silver halide grains as described above.

29 Claims, No Drawings

HIGH CHLORIDE EMULSIONS DOPED WITH COMBINATION OF METAL COMPLEXES

FIELD OF THE INVENTION

This invention is directed to radiation sensitive silver halide emulsions useful in photography, including electronic printing methods wherein information is recorded in a pixel-by-pixel mode in a radiation silver halide emulsion layer, comprising a combination of specified classes of dopants.

DEFINITION OF TERMS

The term "high chloride" in referring to silver halide grains and emulsions indicates that chloride is present in a concentration of greater than 50 mole percent, based on total silver.

In referring to grains and emulsions containing two or more halides, the halides are named in order of ascending concentrations.

All references to the periodic table of elements periods and groups in discussing elements are based on the Periodic Table of Elements as adopted by the American Chemical Society and published in the *Chemical and Engineering News*, Feb. 4, 1985, p. 26. The term "Group VIII" is used to generically describe elements in groups 8, 9 and 10.

The term "central portion" in referring to silver halide grains refers to that portion of the grain structure that is first precipitated accounting for up to 99 percent of total precipitated silver required to form the {100} crystal faces of the grains.

The term "dopant" is employed to indicate any material within the rock salt face centered cubic crystal lattice structure of the central portion of a silver halide grain other than silver ion or halide ion.

The term "surface modifier" refers to any material other than silver ion or halide ion that is associated with a portion of the silver halide grains other than the central portion.

The term "gelatino-peptizer" is employed to designate a gelatin peptizer or a peptizer derived from gelatin, such as acetylated or phthalated gelatin.

The term "low methionine" in referring to gelatino-peptizers indicates a methionine level of less than 30 micromoles per gram.

The term "tabular grain" indicates a grain having two parallel major crystal faces (face which are clearly larger than any remaining crystal face) and having an aspect ratio of at least 2.

The term "aspect ratio" designates the ratio of the average edge length of a major face to grain thickness.

The term "tabular grain emulsion" refers to an emulsion in which tabular grains account for greater than 50 percent of total grain projected area.

The term "{100} tabular" is employed in referring to tabular grains and tabular grain emulsions in which the tabular grains have {100} major faces.

The term "log E" is the logarithm of exposure in lux-seconds.

Speed is reported as relative log speed, where 1.0 relative log speed units is equal to 0.01 log E.

The term "contrast" or "γ" is employed to indicate the slope of a line drawn from stated density points on the characteristic curve.

The term "reciprocity law failure" refers to the variation in response of an emulsion to a fixed light exposure due to variation in the specific exposure time.

*Research Disclosure* is published by Kenneth Mason Publications, Ltd., Dudley House, 12 North St., Emsworth, Hampshire P010 7DQ, England.

BACKGROUND

The use of dopants in silver halide grains to modify photographic performance is generally illustrated by *Research Disclosure*, Item 38957, cited above, I. Emulsion grains and their preparation, D. Grain modifying conditions and adjustments, paragraphs (3)–(5). Photographic performance attributes known to be affected by dopants include sensitivity, reciprocity failure, and contrast.

Using empirical techniques the art has over the years identified many dopants capable of increasing photographic speed. Keevert et al U.S. Pat. No. 4,945,035, e.g., was the first to teach the incorporation of a hexacoordination complex containing a transition metal and cyano ligands as a dopant in high chloride grains to provide increased sensitivity. Scientific investigations have gradually established that one general class of such speed increasing dopants share the capability of providing shallow electron trapping sites. Olm et al U.S. Pat. No. 5,503,970 and Daubendiek et al U.S. Pat. Nos. 5,494,789 and 5,503,971, here incorporated by reference, as well as *Research Disclosure*, Vol. 367, November 1994, Item 36736, were the first to set out comprehensive criteria for a dopant to have the capability of providing shallow electron trapping sites.

Careful scientific investigations have revealed Group VIII hexahalo coordination complexes to create deep electron traps, as illustrated R. S. Eachus, R. E. Graves and M. T. Olm *J. Chem. Phys.*, Vol. 69, pp. 4580–7 (1978) and *Physica Status Solidi A*, Vol. 57, 429–37 (1980) and R. S. Eachus and M. T. Olm *Annu. Rep. Prog. Chem. Sect. C. Phys. Chem.*, Vol. 83, 3, pp. 3–48 (1986). Doping with iridium hexachloride complexes, e.g., is commonly performed to reduce reciprocity law failure in silver halide emulsions. According to the photographic law of reciprocity, a photographic element should produce the same image with the same exposure, even though exposure intensity and time are varied. For example, an exposure for 1 second at a selected intensity should produce exactly the same result as an exposure of 2 seconds at half the selected intensity. When photographic performance is noted to diverge from the reciprocity law, this is known as reciprocity failure. Specific iridium dopants include those illustrated in high chloride emulsions by Bell U.S. Pat. Nos. 5,474,888, 5,470,771 and 5,500,335 and McIntyre et al U.S. Pat. No. 5,597,686. Specific combinations of iridium and other metal dopants may additionally be found in U.S. Pat. Nos. 4,828,962, 5,153,110, 5,219,722, 5,227,286, and 5,229,263, and European Patent Applications EP 0 244 184, EP 0 405 938, EP 0 476 602, EP 0 488601, EP0488737, EP0513 748, and EP0514675.

Many known imaging systems require that a hard copy be provided from an image which is in digital form. A typical example of such a system is electronic printing of photographic images which involves control of individual pixel exposure. Such a system provides greater flexibility and the opportunity for improved print quality in comparison to optical methods of photographic printing. In a typical electronic printing method, an original image is first scanned to create a digital representation of the original scene. The data obtained is usually electronically enhanced to achieve desired effects such as increased image sharpness, reduced graininess and color correction. The exposure data is then provided to an electronic printer which reconstructs the data into a photographic print by means of small discrete elements (pixels) that together constitute an image. In a conventional electronic printing method, the recording element is scanned by one or more high energy beams to provide a short duration exposure in a pixel-by-pixel mode using a suitable source, such as a light emitting diode (LED) or laser. A cathode ray tube (CRT) is also sometimes used as a printer light source in some devices. Such methods are described in the patent literature, including, for example, Hioki U.S. Pat. No. 5,126,235; European Patent Application 479 167 A1 and European Patent Application 502 508 A1. Also, many of the basic principles of electronic printing are provided in Hunt, *The Reproduction of Colour*, Fourth Edition, pages 306–307, (1987).

Budz et al U.S. Pat. No. 5,451,490 discloses an improved electronic printing method which comprises subjecting a radiation sensitive silver halide emulsion layer of a recording element to actinic radiation of at least $10^{-4}$ ergs/cm$^2$ for up to 100$\mu$ seconds duration in a pixel-by-pixel mode. The radiation sensitive silver halide emulsion layer contains a silver halide grain population comprising at least 50 mole percent chloride, based on silver, forming the grain population projected area. At least 50 percent of the grain population projected area is accounted for by tabular grains that are bounded by {100} major faces having adjacent edge ratios of less than 10, each having an aspect ratio of at least 2. The substitution of a high chloride tabular grain emulsion for a high chloride cubic grain emulsion was demonstrated to reduce high intensity reciprocity failure (HIRF). Budz et al discloses among conventional alternatives (a) dopants and (b) low methionine gelatino-peptizer. Treatment of gelatino-peptizer with an oxidizing agent to lower methionine is disclosed by *Research Disclosure*, Vol. 389, September 1996, Item 38957, II. Vehicles, vehicle extenders, vehicle-like addenda and vehicle related addenda, A. Gelatin and hydrophilic colloid peptizers, paragraph (3).

It has become increasing clear that with the continuing development of a variety of high intensity digital printing devices that photographic print materials with performance invariant to exposure time is increasingly important. When exposure times are reduced below one second to very short intervals (e.g., $10^{-5}$ second or less), higher exposure intensities must be employed to compensate for the reduced exposure times. High intensity reciprocity failure (hereinafter also referred to as HIRF) occurs when photographic performance is noted to depart from the reciprocity law when such shorter exposure times are employed. Print materials which traditionally suffer speed or contrast losses at short exposure times (high intensity exposures) will fail to reproduce detail with high resolution. Text will appear blurred. Through-put of digital print devices will suffer as well. Accordingly, print materials with reduced HIRF are desired in order to produce excellent photographic prints in a wide variety of digital printers.

In addition to reducing HIRF, it is also desirable to reduce low intensity reciprocity failure (LIRF) in photographic elements. Print materials with reduced LIRF, e.g., will allow enlargements of photographs to be made by conventional optical printing techniques with a more faithful matching of image tone and color.

Accordingly, a current challenge in the manufacture of photographic materials, and in particular color photographic print materials such as photographic color paper, is to develop silver halide emulsions which achieve reduced reciprocity at both high and low intensity exposures. High intensity reciprocity can be obtained through the use of iridium dopants as discussed above. However, this requires relatively high levels of iridium doping which may lead to latent image keeping problems as well as speed and contrast loss.

U.S. Pat. Nos. 5,783,373 and 5,783,378 discuss use of combinations of shallow and deep electron trapping dopants for high chloride emulsions in combination with low methionine gelatino-peptizer in order to provide increased contrast in a photographic print material used in digital imaging. The use of low methionine oxidized gelatin, however, may result in storage fog (Dmin keeping) problems and increased cost.

The use of dopant coordination complexes containing organic ligands is disclosed by Olm et al U.S. Pat. No. 5,360,712, Olm et al U.S. Pat. No. 5,457,021 and Kuromoto et al U.S. Pat. No. 5,462,849.

SUMMARY OF THE INVENTION

In one aspect this invention is directed towards a radiation-sensitive emulsion comprised of silver halide grains (a) containing greater than 50 mole percent chloride, based on silver, (b) having greater than 50 percent of their surface area provided by {100} crystal faces, and (c) having a central portion accounting for from 95 to 99 percent of total silver and containing two dopants selected to satisfy each of the following class requirements: (i) a hexacoordination metal complex which satisfies the formula $$[ML_6]^n \quad \text{(I)}$$

wherein n is zero, −1, −2, −3 or −4; M is a filled frontier orbital polyvalent metal ion, other than iridium; and $L_6$ represents bridging ligands which can be independently selected, provided that least four of the ligands are anionic ligands, and at least one of the ligands is a cyano ligand or a ligand more electronegative than a cyano ligand; and (ii) an iridium coordination complex containing a thiazole or substituted thiazole ligand.

In a second aspect, this invention is directed towards a photographic recording element comprising a support and at least one light sensitive silver halide emulsion layer comprising silver halide grains as described above.

In another aspect, this invention is directed to an electronic printing method which comprises subjecting a radiation sensitive silver halide emulsion layer of a recording element to actinic radiation of at least $10^{-4}$ ergs/cm$^2$ for up to 100$\mu$ seconds duration in a pixel-by-pixel mode, wherein the silver halide emulsion layer is comprised of silver halide grains as described above.

It has been discovered quite surprisingly that the combination of dopants (i) and (ii) provides greater reduction in reciprocity law failure than can be achieved with either dopant alone. Further, unexpectedly, the combination of dopants (i) and (ii) achieve reductions in reciprocity law failure beyond the simple additive sum achieved when employing either dopant class by itself. It has not been reported or suggested prior to this invention that the combination of dopants (i) and (ii) provides greater reduction in reciprocity law failure, particularly for high intensity and short duration exposures. The combination of dopants (i) and (ii) further unexpectedly achieves high intensity reciprocity with iridium at relatively low levels, and both high and low intensity reciprocity improvements even while using conventional gelatino-peptizer (e.g., other than low methionine gelatino-peptizer).

In a preferred practical application, the advantages of the invention can be transformed into increased throughput of digital artifact-free color print images while exposing each pixel sequentially in synchronism with the digital data from an image processor.

DESCRIPTION OF PREFERRED EMBODIMENTS

In one embodiment, the present invention represents an improvement on the electronic printing method disclosed by Budz et al, cited above and here incorporated by reference. Specifically, this invention in one embodiment is directed to an electronic printing method which comprises subjecting a radiation sensitive silver halide emulsion layer of a recording element to actinic radiation of at least $10^{-4}$ ergs/cm$^2$ for up to 100$\mu$ seconds duration in a pixel-by-pixel mode. The present invention realizes an improvement in reciprocity failure by modifying the radiation sensitive silver halide emulsion layer. While certain embodiments of the invention are specifically directed towards electronic printing, use of the emulsions and elements of the invention is not limited to such specific embodiment, and it is specifically contemplated that the emulsions and elements of the invention are also well suited for conventional optical printing.

It has been unexpectedly discovered that significantly improved reciprocity performance can be obtained for silver halide grains (a) containing greater than 50 mole percent chloride, based on silver, and (b) having greater than 50 percent of their surface area provided by {100} crystal faces by employing a hexacoordination complex dopant of class (i) in combination with an iridium complex dopant comprising a thiazole or substituted thiazole ligand. The reciprocity improvement is obtained for silver halide grains employing conventional gelatino-peptizer, unlike the contrast improvement described for the combination of dopants set forth in U.S. Pat. Nos. 5,783,373 and 5,783,378 referenced above, which requires the use of low methionine gelatino-peptizers as discussed therein, and which states it is preferable to limit the concentration of any gelatino-peptizer with a methionine level of greater than 30 micromoles per gram to a concentration of less than 1 percent of the total peptizer employed. Accordingly, in specific embodiments of the invention, it is specifically contemplated to use significant levels (i.e., greater than 1 weight percent of total peptizer) of conventional gelatin (e.g., gelatin having at least 30 micromoles of methionine per gram) as a gelatino-peptizer for the silver halide grains of the emulsions of the invention. In preferred embodiments of the invention, gelatino-peptizer is employed which comprises at least 50 weight percent of gelatin containing at least 30 micromoles of methionine per gram, as it is frequently desirable to limit the level of oxidized low methionine gelatin which may be used for cost and certain performance reasons.

In a specific, preferred form of the invention it is contemplated to employ a class (i) hexacoordination complex dopant satisfying the formula:

$$[ML_6]^n \quad \text{(I)}$$

where n is zero, −1, −2, −3 or −4;

M is a filled frontier orbital polyvalent metal ion, other than iridium, preferably $Fe^{+2}$, $Ru^{+2}$, $Os^{+2}$, $Co^{+3}$, $Rh^{+3}$, $Pd^{+4}$ or $Pt+^{4}$, more preferably an iron, ruthenium or osmium ion, and most preferably a ruthenium ion;

$L_6$ represents six bridging ligands which can be independently selected, provided that least four of the ligands are anionic ligands and at least one (preferably at least 3 and optimally at least 4) of the ligands is a cyano ligand or a ligand more electronegative than a cyano ligand. Any remaining ligands can be selected from among various other bridging ligands, including aquo ligands, halide ligands (specifically, fluoride, chloride, bromide and iodide), cyanate ligands, thiocyanate ligands, selenocyanate ligands, tellurocyanate ligands, and azide ligands. Hexacoordinated transition metal complexes of class (i) which include six cyano ligands are specifically preferred.

Illustrations of specifically contemplated class (i) hexacoordination complexes for inclusion in the high chloride grains are provided by Bell, cited above, Olm et al U.S. Pat. No. 5,503,970 and Daubendiek et al U.S. Pat. Nos. 5,494,789 and 5,503,971, and Keevert et al U.S. Pat. No. 4,945,035, the disclosures of which are here incorporated by reference, as well as Murakami et al Japanese Patent Application Hei-2[1990]-249588, and *Research Disclosure* Item 36736, the disclosures of which are here incorporated by reference. Useful neutral and anionic organic ligands for class (ii) dopant hexacoordination complexes are disclosed by Olm et al U.S. Pat. No. 5,360,712 and Kuromoto et al U.S. Pat. No. 5,462,849, the disclosures of which are here incorporated by reference.

Class (i) dopant is preferably introduced into the high chloride grains after at least 50 (most preferably 75 and optimally 80) percent of the silver has been precipitated, but before precipitation of the central portion of the grains has been completed. Preferably class (i) dopant is introduced before 98 (most preferably 95 and optimally 90) percent of the silver has been precipitated. Stated in terms of the fully precipitated grain structure, class (i) dopant is preferably present in an interior shell region that surrounds at least 50 (most preferably 75 and optimally 80) percent of the silver and, with the more centrally located silver, accounts the entire central portion (99 percent of the silver), most preferably accounts for 95 percent, and optimally accounts for 90 percent of the silver halide forming the high chloride grains. The class (i) dopant can be distributed throughout the interior shell region delimited above or can be added as one or more bands within the interior shell region.

Class (i) dopant can be employed in any conventional useful concentration. A preferred concentration range is from $10^{-8}$ to $10^{-3}$ mole per silver mole, most preferably from $10^{-6}$ to $5\times10^{-4}$ mole per silver mole.

The following are specific illustrations of class (i) dopants:

(i-1) $[Fe(CN)_6]^{-4}$
(i-2) $[Ru(CN)_6]^{-4}$
(i-3) $[Os(CN)_6]^{-4}$
(i-4) $[Rh(CN)_6]^{-3}$
(i-5) $[Co(CN)_6]^{-3}$
(i-6) $[Fe(pyrazine)(CN)_5]^{-4}$
(i-7) $[RuCl(CN)_5]^{-4}$
(i-8) $[OsBr(CN)_5]^{-4}$
(i-9) $[RhF(CN)_5]^{-3}$
(i-10) $[In(NCS)_6]^{-3}$
(i-11) $[FeCO(CN)_5]^{-3}$
(i-12) $[RuF_2(CN)_4]^{-4}$
(i-13) $[OsCl_2(CN)_4]^{-4}$
(i-14) $[RhI_2(CN)_4]^{-3}$
(i-15) $[Ga(NCS)_6]^{-3}$
(i-16) $[Ru(CN)_5(OCN)]^{-4}$
(i-17) $[Ru(CN)_5(N_3)]^{-4}$
(i-18) $[Os(CN)_5(SCN)]^{-4}$
(i-19) $[Rh(CN)_5(SeCN)]^{-3}$
(i-20) $[Os(CN)Cl_5]^{-4}$ (i-21) $[Fe(CN)_3Cl_3]^{-3}$
(i-22) $[Ru(CO)_2(CN)_4]^{-1}$ When the class (i) dopants have a net negative charge, it is appreciated that they are associated with a counter ion when added to the reaction vessel during precipitation. The counter ion is of little importance, since it is ionically dissociated from the dopant in solution and is not incorporated within the grain. Common counter ions known to be fully compatible with silver chloride precipitation, such as ammonium and alkali metal ions, are contemplated. It is noted that the same comments apply to class (ii) dopants, otherwise described below.

The class (ii) dopant is an iridium coordination complex containing at least one thiazole or substituted thiazole ligand. Careful scientific investigations have revealed Group VIII hexahalo coordination complexes to create deep electron traps, as illustrated R. S. Eachus, R. E. Graves and M. T. Olm *J Chem. Phys.*, Vol. 69, pp. 4580–7 (1978) and *Physica Status Solidi A*, Vol. 57, 429–37 (1980) and R. S. Eachus and M. T. Olm *Annu. Rep. Prog. Chem. Sect. C. Phys. Chem.,* Vol. 83, 3, pp. 3–48 (1986). The class (ii) dopants employed in the practice of this invention are believed to create such deep electron traps. The thiazole ligands may be substituted with any photographically acceptable substituent which does not prevent incorporation of the dopant into the silver halide grain. Exemplary substituents include lower alkyl (e.g., alkyl groups containing 1–4 carbon atoms), and specifically methyl. A specific example of a substituted thiazole ligand which may be used in accordance with the invention is 5-methylthiazole. The class (ii) dopant preferably is an iridium coordination complex having ligands each of which are more electropositive than a cyano ligand. In a specifically preferred form the remaining non-thiazole or non-substituted-thiazole ligands of the coordination complexes forming class (ii) dopants are halide ligands.

It is specifically contemplated to select class (ii) dopants from among the coordination complexes containing organic ligands disclosed by Olm et al U.S. Pat. No. 5,360,712, Olm et al U.S. Pat. No. 5,457,021 and Kuromoto et al U.S. Pat. No. 5,462,849, the disclosures of which are here incorporated by reference.

In a preferred form it is contemplated to employ as a class (ii) dopant a hexacoordination complex satisfying the formula:

$$[IrL^1_6]^{n'} \quad \text{(II)}$$

wherein n' is zero, −1, −2, −3 or −4; and $L^1_6$ represents six bridging ligands which can be independently selected, provided that at least four of the ligands are anionic ligands, each of the ligands is more electropositive than a cyano ligand, and at least one of the ligands comprises a thiazole or substituted thiazole ligand. In a specifically preferred form at least four of the ligands are halide ligands, such as chloride or bromide ligands.

Class (ii) dopant is preferably introduced into the high chloride grains after at least 50 (most preferably 85 and optimally 90) percent of the silver has been precipitated, but before precipitation of the central portion of the grains has been completed. Preferably class (ii) dopant is introduced before 99 (most preferably 97 and optimally 95) percent of the silver has been precipitated. Stated in terms of the fully precipitated grain structure, class (ii) dopant is preferably present in an interior shell region that surrounds at least 50 (most preferably 85 and optimally 90) percent of the silver and, with the more centrally located silver, accounts the entire central portion (99 percent of the silver), most preferably accounts for 97 percent, and optimally accounts for 95 percent of the silver halide forming the high chloride grains. The class (ii) dopant can be distributed throughout the interior shell region delimited above or can be added as one or more bands within the interior shell region.

Class (ii) dopant can be employed in any conventional useful concentration. A preferred concentration range is from $10^{-9}$ to $10^{-4}$ mole per silver mole. Iridium is most preferably employed in a concentration range of from $10^{-8}$ to $10^{-5}$ mole per silver mole.

Specific illustrations of class (ii) dopants are the following:

(ii-1) $[IrCl_5(\text{thiazole})]^{-2}$
(ii-2) $[IrCl_4(\text{thiazole})_2]^{-1}$
(ii-3) $[IrBr_5(\text{thiazole})]^{-2}$
(ii-4) $[IrBr_4(\text{thiazole})_2]^{-1}$
(ii-5) $[IrCl_5(\text{5-methylthiazole})]^{-2}$
(ii-6) $[IrCl_4(\text{5-methylthiazole})_2]^{-1}$
(ii-7) $[IrBr_5(\text{5-methylthiazole})]^{-2}$
(ii-8) $[IrBr_4(\text{5-methylthiazole})_2]^{-1}$ Emulsions demonstrating the advantages of the invention can be realized by modifying the precipitation of conventional high chloride silver halide grains having predominantly (>50%) {100} crystal faces by employing a combination of class (i) and (ii) dopants as described above.

The silver halide grains precipitated contain greater than 50 mole percent chloride, based on silver. Preferably the grains contain at least 70 mole percent chloride and, optimally at least 90 mole percent chloride, based on silver. Iodide can be present in the grains up to its solubility limit, which is in silver iodochloride grains, under typical conditions of precipitation, about 11 mole percent, based on silver. It is preferred for most photographic applications to limit iodide to less than 5 mole percent iodide, most preferably less than 2 mole percent iodide, based on silver.

Silver bromide and silver chloride are miscible in all proportions. Hence, any portion, up to 50 mole percent, of the total halide not accounted for chloride and iodide, can be bromide. For color reflection print (i.e., color paper) uses bromide is typically limited to less than 10 mole percent based on silver and iodide is limited to less than 1 mole percent based on silver.

In a widely used form high chloride grains are precipitated to form cubic grains—that is, grains having {100} major faces and edges of equal length. In practice ripening effects usually round the edges and comers of the grains to some extent. However, except under extreme ripening conditions substantially more than 50 percent of total grain surface area is accounted for by {100} crystal faces.

High chloride tetradecahedral grains are a common variant of cubic grains. These grains contain 6 {100} crystal faces and 8 {111} crystal faces. Tetradecahedral grains are within the contemplation of this invention to the extent that greater than 50 percent of total surface area is accounted for by {100} crystal faces.

Although it is common practice to avoid or minimize the incorporation of iodide into high chloride grains employed in color paper, it is has been recently observed that silver iodochloride grains with {100} crystal faces and, in some instances, one or more {111} faces offer exceptional levels of photographic speed. In the these emulsions iodide is incorporated in overall concentrations of from 0.05 to 3.0 mole percent, based on silver, with the grains having a surface shell of greater than 50 Å that is substantially free of iodide and a interior shell having a maximum iodide concentration that surrounds a core accounting for at least 50 percent of total silver. Such grain structures are illustrated by Chen et al EPO 0 718 679.

In another improved form the high chloride grains can take the form of tabular grains having {100} major faces. Preferred high chloride {100} tabular grain emulsions are those in which the tabular grains account for at least 70 (most preferably at least 90) percent of total grain projected area. Preferred high chloride {100} tabular grain emulsions have average aspect ratios of at least 5 (most preferably at least >8). Tabular grains typically have thicknesses of less than 0.3 $\mu$m, preferably less than 0.2 $\mu$m, and optimally less than 0.07 $\mu$m. High chloride {100} tabular grain emulsions and their preparation are disclosed by Maskasky U.S. Pat. Nos. 5,264,337 and 5,292,632, House et al U.S. Pat. No. 5,320,938, Brust et al U.S. Pat. No. 5,314,798 and Chang et al U.S. Pat. No. 5,413,904, the disclosures of which are here incorporated by reference.

Once high chloride grains having predominantly {100} crystal faces have been precipitated with a combination of class (i) and class (ii) dopants described above, chemical and spectral sensitization, followed by the addition of conventional addenda to adapt the emulsion for the imaging application of choice can take any convenient conventional form. These conventional features are illustrated by *Research Disclosure*, Item 38957, cited above, particularly:

III. Emulsion washing;

IV. Chemical sensitization;

V. Spectral sensitization and desensitization;

VII. Antifoggants and stabilizers;

VIII. Absorbing and scattering materials;

IX. Coating and physical property modifying addenda; and

X. Dye image formers and modifiers.

As pointed out by Bell, cited above, some additional silver halide, typically less than 1 percent, based on total silver, can be introduced to facilitate chemical sensitization. It is also recognized that silver halide can be epitaxially deposited at selected sites on a host grain to increase its sensitivity. For example, high chloride {100} tabular grains with corner epitaxy are illustrated by Maskasky U.S. Pat. No. 5,275,930. For the purpose of providing a clear demarcation, the term "silver halide grain" is herein employed to include the silver necessary to form the grain up to the point that the final {100} crystal faces of the grain are formed. Silver halide later deposited that does not overlie the {100} crystal faces previously formed accounting for at least 50 percent of the grain surface area is excluded in determining total silver forming the silver halide grains. Thus, the silver forming selected site epitaxy is not part of the silver halide grains while silver halide that deposits and provides the final {100} crystal faces of the grains is included in the total silver forming the grains, even when it differs significantly in composition from the previously precipitated silver halide.

In the simplest contemplated form a recording element contemplated for use in the electronic printing method of one embodiment of the invention can consist of a single emulsion layer satisfying the emulsion description provided above coated on a conventional photographic support, such as those described in *Research Disclosure*, Item 38957, cited above, XVI. Supports. In one preferred form the support is a white reflective support, such as photographic paper support or a film support that contains or bears a coating of a reflective pigment. To permit a print image to be viewed using an illuminant placed behind the support, it is preferred to employ a white translucent support, such as a Duratrans™ or Duraclear™ support.

The method of the invention can be used to form either silver or dye images in the recording element. In a simple form a single radiation sensitive emulsion layer unit is coated on the support. The emulsion layer unit can contain one or more high chloride silver halide emulsions satisfying the requirements of the invention, either blended or located in separate layers. When a dye imaging forming compound, such as a dye-forming coupler, is present in the layer unit, it can be present in an emulsion layer or in a layer coated in contact with the emulsion layer. With a single emulsion layer unit a monochromatic image is obtained.

In a preferred embodiment the invention employs recording elements which are constructed to contain at least three silver halide emulsion layer units. A suitable multicolor, multilayer format for a recording element used in the invention is represented by Structure I.

| STRUCTURE I |
|---|
| Blue-sensitized<br>yellow dye image-forming silver halide emulsion unit |
| Interlayer |
| Green-sensitized<br>magenta dye image-forming silver halide emulsion unit |
| Interlayer |
| Red-sensitized<br>cyan dye image-forming silver halide emulsion unit |
| ///// Support ///// |

wherein the red-sensitized, cyan dye image-forming silver halide emulsion unit is situated nearest the support; next in order is the green-sensitized, magenta dye image-forming unit, followed by the uppermost blue-sensitized, yellow dye image-forming unit. The image-forming units are separated from each other by hydrophilic colloid interlayers containing an oxidized developing agent scavenger to prevent color contamination. Silver halide emulsions satisfying the grain and gelatino-peptizer requirements described above can be present in any one or combination of the emulsion layer units. Additional useful multicolor, multilayer formats for an element of the invention include Structures II–IV as described in U.S. Pat. No. 5,783,373 referenced above, which is incorporated by reference herein. Each of such structures in accordance with the invention would contain at least one silver halide emulsion comprised of high chloride grains having at least 50 percent of their surface area bounded by {100} crystal faces and containing dopants from classes (i) and (ii), as described above. Preferably each of the emulsion layer units contain an emulsion satisfying these criteria.

Conventional features that can be incorporated into multilayer (and particularly multicolor) recording elements contemplated for use in the method of the invention are illustrated by *Research Disclosure*, Item 38957, cited above:

XI. Layers and layer arrangements

XII. Features applicable only to color negative

XIII. Features applicable only to color positive

B. Color reversal

C. Color positives derived from color negatives

XIV. Scan facilitating features.

The recording elements comprising the radiation sensitive high chloride emulsion layers according to this invention can be conventionally optically printed, or in accordance with a particular embodiment of the invention can be image-wise exposed in a pixel-by-pixel mode u sing suitable high energy radiation sources typically employed in electronic printing methods. Suitable actinic forms of energy encompass the ultraviolet, visible and infrared regions of the electromagnetic spectrum as well as electron-beam radiation and is conveniently supplied by beams from one or more light emitting diodes or lasers, including gaseous or solid state lasers. Exposures can be monochromatic, orthochromatic or panchromatic. For example, when the recording element is a multilayer multicolor element, exposure can be provided by laser or light emitting diode beams of appropriate spectral radiation, for example, infrared, red, green or blue wavelengths, to which such element is sensitive. Multicolor elements can be employed which produce cyan, magenta and yellow dyes as a function of exposure in separate portions of the electromagnetic spectrum, including at least two portions of the infrared region, as disclosed in the previously mentioned U.S. Pat. No. 4,619,892, incorporated herein by reference. Suitable exposures include those up to 2000 nm, preferably up to 1500 nm. The exposing source need, of course, provide radiation in only one spectral region if the recording element is a monochrome element sensitive to only that region (color) of the electromagnetic spectrum. Suitable light emitting diodes and commercially available laser sources are described in the examples. Image-wise exposures at ambient, elevated or reduced temperatures and/or pressures can be employed within the useful response range of the recording element determined by conventional sensitometric techniques, as illustrated by T. H. James, *The Theory of the Photographic Process,* 4th Ed., Macmillan, 1977, Chapters 4, 6, 17, 18 and 23.

The quantity or level of high energy actinic radiation provided to the recording medium by the exposure source is generally at least $10^{-4}$ ergs/cm$^2$, typically in the range of about $10^{-4}$ ergs/cm$^2$ to $10^{-3}$ ergs/cm$^2$ and often from $10^{-3}$ ergs/cm$^2$ to $10^2$ ergs/cm$^2$. Exposure of the recording element in a pixel-by-pixel mode as known in the prior art persists for only a very short duration or time. Typical maximum exposure times are up to 100$\mu$ seconds, often up to 10$\mu$ seconds, and frequently up to only 0.5$\mu$ seconds. Single or multiple exposures of each pixel are contemplated. The pixel density is subject to wide variation, as is obvious to those skilled in the art. The higher the pixel density, the sharper the images can be, but at the expense of equipment complexity. In general, pixel densities used in conventional electronic printing methods of the type described herein do not exceed $10^7$ pixels/cm$^2$ and are typically in the range of about $10^4$ to $10^6$ pixels/cm$^2$. An assessment of the technology of high-quality, continuous-tone, color electronic printing using silver halide photographic paper which discusses various features and components of the system, including exposure source, exposure time, exposure level and pixel density and other recording element characteristics is provided in Firth et al., *A Continuous-Tone Laser Color Printer*, Journal of Imaging Technology, Vol. 14, No. 3, June 1988, which is hereby incorporated herein by reference. As previously indicated herein, a description of some of the details of conventional electronic printing methods comprising scanning a recording element with high energy beams such as light emitting diodes or laser beams, are set forth in Hioki U.S. Pat. No. 5,126,235, European Patent Applications 479 167 A1 and 502 508 A1, the disclosures of which are hereby incorporated herein by reference.

Once imagewise exposed, the recording elements can be processed in any convenient conventional manner to obtain a viewable image. Such processing is illustrated by *Research Disclosure*, Item 38957, cited above:

XVIII. Chemical development systems

XIX. Development

XX. Desilvering, washing, rinsing and stabilizing

EXAMPLES

This invention can be better appreciated by reference to the following Examples. Emulsions A throughout L illustrate the preparation of radiation sensitive high chloride emulsions, both for comparison and inventive emulsions. Examples 1 through 10 illustrate that recording elements containing layers of such emulsions exhibit characteristics which make them particularly useful in very fast optical printers and in electronic printing methods of the type described herein. The term "regular gelatin" is used to indicate gelatin that was not treated to reduce its methionine content and that had a naturally occurring methionine content of about 50 micrograms per gram.

EMULSION PRECIPITATIONS

Emulsion A

A reaction vessel contained 6.92 L of a solution that was 3.8% in regular gelatin and contained 1.71 g of a Pluronic™ antifoam agent. To this stirred solution at 46° C. 83.5 mL of 3.0 M NaCl was dumped, and soon after 28.3 mL of dithiaoctanediol solution was poured into the reactor. A half minute after addition of dithiaoctanediol solution, 104.5 mL of a 2.8 M $AgNO_3$ solution and 107.5 mL of 3.0 M NaCl were added simultaneously at 209 mL/min for 0.5 minute. The vAg set point was chosen equal to that observed in the reactor at this time. Then the 2.8 M silver nitrate solution and the 3.0 M sodium chloride solution were added simultaneously with a constant flow at 209 mL/min over 20.75 minutes. The resulting silver chloride emulsion had a cubic shape that was 0.38 $\mu$m in edge length. The emulsion was then washed using an ultrafiltration unit, and its final pH and pCl were adjusted to 5.6 and 1.8, respectively.

Emulsion B

This emulsion was precipitated exactly as Emulsion A, except that 16.54 milligrams per silver mole of $K_4Ru(CN)_6$ was added during precipitation during to 80 to 85% of grain formation.

Emulsion C

This emulsion was precipitated exactly as Emulsion A, except that 0.16 milligrams per silver mole of $K_2IrCl_5$ (Thiazole) was added during precipitation during to 90 to 95% of grain formation.

Emulsion D

This emulsion was precipitated exactly as Emulsion A, except that 16.54 milligrams per silver mole of $K_4Ru(CN)_6$ was added during precipitation during to 80 to 85% of grain formation and 0.16 milligrams per silver mole of $K_2IrCl_5$ (Thiazole) was added during precipitation during to 90 to 95% of grain formation.

Emulsion E

This emulsion was precipitated exactly as Emulsion A, except that 0.164 milligrams per silver mole of $K_2IrCl_5$ (5-Methyl-Thiazole) was added during precipitation during to 90 to 95% of grain formation.

Emulsion F

This emulsion was precipitated exactly as Emulsion A, except that 16.54 milligrams per silver mole of $K_4Ru(CN)_6$ was added during precipitation during to 80 to 85% of grain formation and 0.164 milligrams per silver mole of $K_2IrCl_5$ (5-Methyl-Thiazole) was added during precipitation during to 90 to 95% of grain formation.

Emulsion G

A reaction vessel contained 8.65 L of a solution that was 3.97% in regular gelatin and contained 1.75 g of a Pluronic antifoam agent. To this stirred solution at 46.1° C. 79.8 mL of 3.0 M NaCl was dumped, and soon after 25.7 mL of dithiaoctanediol solution was poured into the reactor. A half minute after addition of dithiaoctanediol solution, 133.1 mL of a 2.8 M $AgNO_3$ solution and 129.9 mL of 3.0 M NaCl were added simultaneously at 128.2 mL/min for 0.75 minute. The vAg set point was chosen equal to that observed in the reactor at this time. Then the 2.8 M silver nitrate solution and the 3.0 M sodium chloride solution were added simultaneously with a constant flow at 128.2 mL/min over 22.3 minutes. The resulting silver chloride emulsion had a cubic shape that was 0.29 $\mu$m in edge length. The emulsion was then washed using an ultrafiltration unit, and its final pH and pCl were adjusted to 5.6 and 1.8, respectively.

Emulsion H

This emulsion was precipitated exactly as Emulsion G, except that 16.54 milligrams per silver mole of $K_4Ru(CN)_6$ was added during precipitation during to 80 to 85% of grain formation.

Emulsion I

This emulsion was precipitated exactly as Emulsion G, except that 0.1656 milligrams per silver mole of $K_2IrCl_5$ (5-Methyl-Thiazole) was added during precipitation during to 90 to 95% of grain formation.

Emulsion J

This emulsion was precipitated exactly as Emulsion G, except that 16.54 milligrams per silver mole of $K_4Ru(CN)_6$ was added during precipitation during to 80 to 85% of grain formation and 0.1656 milligrams per silver mole of $K_2IrCl_5$ (5-Methyl-Thiazole) was added during precipitation during to 90 to 95% of grain formation.

Emulsion K

This emulsion was precipitated exactly as Emulsion G, except that 0.3312 milligrams per silver mole of $K_2IrCl_5$ (5-Methyl-Thiazole) was added during precipitation during to 90 to 95% of grain formation.

Emulsion L

This emulsion was precipitated exactly as Emulsion G, except that 16.54 milligrams per silver mole of $K_4Ru(CN)_6$ was added during precipitation during to 80 to 85% of grain formation and 0.3312 milligrams per silver mole of $K_2IrCl_5$ (5-Methyl-Thiazole) was added during precipitation during to 90 to 95% of grain formation.

SENSITIZATION OF EMULSIONS

The emulsions were each optimally sensitized by the customary techniques using two basic sensitization schemes. The sequence of chemical sensitizers, spectral sensitizers, and antifoggants addition are the same for each finished emulsion. Both colloidal gold sulfide or gold(I) (as disclosed in copending, commonly assigned U.S. Ser. No. 08/965,507 filed Nov. 6, 1997) and $Na_2S_2O_3$ were used for chemical sensitization. Detailed procedures are described in the Examples below.

In red-sensitized emulsions the following red spectral sensitizing dyes were used:

Spectral Sensitizing Dye A

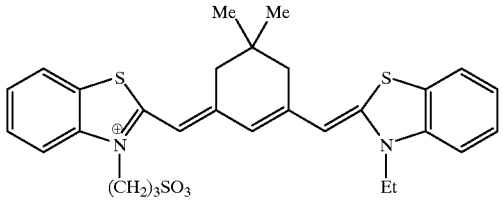

Spectral Sensitizing dye B

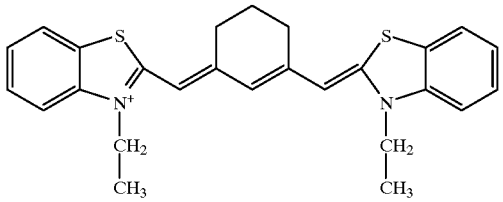

Just prior to coating on resin coated paper support red-sensitized emulsions were dual-mixed with cyan dye forming coupler A Coupler A:

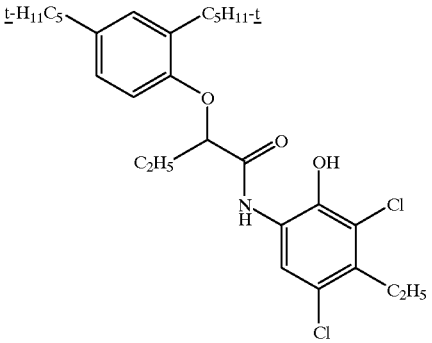

In green-sensitized emulsions the following green spectral sensitizing dye was used:

Spectral Sensitizing Dye C

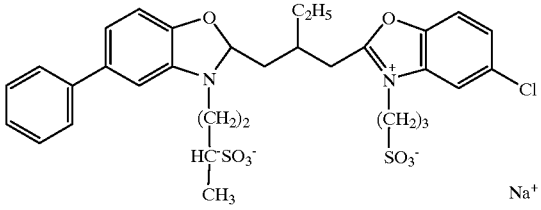

Just prior to coating on resin coated paper support green-sensitized emulsions were dual-mixed with magenta dye forming coupler B:

Coupler B

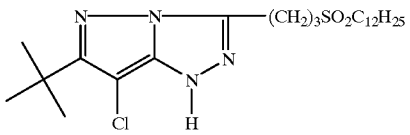

The red sensitized emulsions were coated at 194 mg silver per square meter while green sensitized emulsions were coated at 108 mg silver per square meter on resign-coated paper support. The coatings were overcoated with gelatin layer and the entire coating was hardened with bis (vinlsulfonymethyl)ether.

Part 1.1: A portion of silver chloride Emulsion A was optimally sensitized by the addition of p-glutaramidophenyl disulfide (GDPD) followed by addition of stilbene, followed by the optimum amount of $Na_2S_2O_3$ followed by addition of gold(I). The emulsion was then heated to 65° C. and held at this temperature for 30 minutes with subsequent addition of 1-(3-acetamidophenyl)-5-mercaptotetrazole followed by addition of Lippmann bromide and followed by addition of Spectral Sensitizing dye B. Then the emulsion was cooled to 40° C.

Part 1.2: A portion of silver chloride Emulsion B was sensitized exactly as in Part 1.1.

Part 1.3: A portion of silver chloride Emulsion C was sensitized exactly as in Part 1.1.

Part 1.4: A portion of silver chloride Emulsion D was sensitized exactly as in Part 1.1.

Sensitometric Data are Summarized in Table I

TABLE I

| | | | Optical Sensitivity | | | |
|---|---|---|---|---|---|---|
| Coating | mg $K_4Ru(CN)_6$/ | mg $K_2IrCl_5$ (Tz)/ | HIRF $10^{-2}$ s–$10^{-4}$s | | LIRF 10 s–0.1 s | |
| ID | Ag mole | Ag mole | Dmin + 1.3 | Dmin + 1.95 | Dmin + 1.3 | Dmin + 1.95 |
| Part 1.1 | — | — | 32.3 | 34.3 | 16.5 | 17.0 |
| Part 1.2 | 16.54 | — | 25.3 | 24.2 | 13.5 | 16.6 |
| Part 1.3 | — | 0.16 | 27.3 | 26.4 | 12.3 | 12.4 |
| Part 1.4 | 16.54 | 0.16 | −1.7 | 0.7 | 0.3 | 1.0 |

PHOTOGRAPHIC COMPARISONS

Coatings were exposed through a step wedge with 3000 K tungsten source at high-intensity short exposure times ($10^{-2}$ to $10^{-4}$ second for red sensitized emulsions and $10^{-3}$ to $10^{-5}$ second for green sensitized emulsions) or low-intensity, long exposure time of 10 to 0.1 second for red sensitized emulsions and 1 to $10^{-2}$ second for green sensitized emulsions. The total energy of each exposure was kept at a constant level. Speed is reported as relative log speed (RLS) at specified level above the minimum density as presented in the following Examples. In relative log speed units a speed difference of 30, for example, is a difference of 0.30 log E, where E is exposure in lux-seconds. These exposures will be referred to as "Optical Sensitivity" in the following Examples.

Coatings were also exposed with Toshiba TOLD 9140™ exposure apparatus at 691 nm (red sensitized emulsions) or 532 nm (green sensitized emulsions), a resolution of 176.8 pixels/cm, a pixel pitch of 42.47 $\mu$m, and the exposure time of 1 microsecond per pixel. These exposures will be referred to as "Digital Sensitivity" in the following Examples.

All coatings were processed in Kodak™ Ektacolor RA-4. Relative optical speeds were reported at Dmin+1.3 or Dmin+1.95 density levels. Relative laser speeds were reported at Dmin+1.9 density level, and laser contrast was measured between Dmin+0.2 and Dmin+1.8.

Example 1

This example compares effects of $K_4Ru(CN)_6$ and $K_2IrCl_5$(Thiazole) synergy on shoulder reciprocity failure. In each case, silver chloride cubic emulsions sensitized for red color record were used. The sensitization details are as follows:

The above results demonstrate that while each individual dopant results in a modest improvement in reciprocity performance, the combination of dopants in accordance with the invention essentially eliminate reciprocity failure for both relatively high and low intensity exposures.

Example 2

This example compares effects of $K_4Ru(CN)_6$ and $K_2IrCl_5$(Thiazole) synergy on shoulder reciprocity failure. In each case, silver chloride cubic emulsions sensitized for red color record were used. The sensitization details are as follows:

Part 2.1: A portion of silver chloride Emulsion A was optimally sensitized by the addition of GDPD followed by addition of a stilbene compound, followed by a heat ramp up to 65° C. Then Lippmann bromide was added followed by addition of the optimum amount of $Na_2S_2O_3$, followed by addition of gold(I), and subsequent addition of 1-(3-acetamidophenyl)-5-mercaptotetrazole. Then the emulsion was cooled to 40° C. and Spectral Sensitizing Dye A was added.

Part 2.2: A portion of silver chloride Emulsion B was sensitized exactly as in Part 2.1.

Part 2.3: A portion of silver chloride Emulsion C was sensitized exactly as in Part 2.1.

Part 2.4: A portion of silver chloride Emulsion D was sensitized exactly as in Part 2.1.

Sensitometric Data are Summarized in Table II

TABLE II

| Coating ID | mg $K_4Ru(CN)_6$/ Ag mole | mg $K_2IrCl_5$ (Tz)/ Ag mole | Optical Sensitivity HIRF $10^{-2}$ s–$10^{-4}$s Dmin + 1.3 | HIRF Dmin + 1.95 | LIRF 10 s–0.1 s Dmin + 1.3 | LIRF Dmin + 1.95 |
|---|---|---|---|---|---|---|
| Part 2.1 | — | — | 39.1 | 42.1 | 2.4 | 2.6 |
| Part 2.2 | 16.54 | — | 32.3 | 34.3 | 1.9 | 2.1 |
| Part 2.3 | — | 0.16 | 25.9 | 33.0 | 1.8 | 1.5 |
| Part 2.4 | 16.54 | 0.16 | −7.0 | −9 | 0.6 | 0.1 |

The above results demonstrate that while each individual dopant results in a modest improvement in reciprocity performance, the combination of dopants in accordance with the invention essentially eliminate reciprocity failure for both relatively high and low intensity exposures.

Example 3

This example compares effects of $K_4Ru(CN)_6$ and $K_2IrCl_5$(Thiazole) synergy on shoulder reciprocity failure. In each case, silver chloride cubic emulsions sensitized for red color record were used. The sensitization details are as follows:

Part 3.1: A portion of silver chloride Emulsion A was optimally sensitized by the addition of Lippmann bromide doped with iridium hexachloride. The emulsion was then heated to 65° C. and held at this temperature for 10 minutes with subsequent addition of p-glutaramidophenyl disulfide (GDPD) followed by the optimum amount of gold(I) followed by addition of $Na_2S_2O_3$ with subsequent addition stilbene followed by addition of Spectral Sensitizing Dye B followed by addition of 1-(3-acetamidophenyl)-5-mercaptotetrazole. Then the emulsion was cooled to 40° C.

Part 3.2: A portion of silver chloride Emulsion B was sensitized exactly as in Part 3.1.

Part 3.3: A portion of silver chloride Emulsion C was sensitized exactly as in Part 3.1.

Part 3.4: A portion of silver chloride Emulsion D was sensitized exactly as in Part 3.1.

Sensitometric Data are Summarized in Table III

The above results again demonstrate that the combination of dopants in accordance with the invention can essentially eliminate reciprocity failure for both relatively high and low intensity exposures. Also, significant increased speed and contrast are exhibited for digital exposures in accordance with preferred embodiments of the invention.

Example 4

This example compares effects of $K_4Ru(CN)_6$ and $K_2IrCl_5$(Thiazole) synergy on shoulder reciprocity failure. In each case, silver chloride cubic emulsions sensitized for red color record were used. The sensitization details are as follows:

Part 4.1: A portion of silver chloride Emulsion A was optimally sensitized by the addition of p-glutaramidophenyl disulfide (GDPD), followed by the optimum amount of $Na_2S_2O_3$ followed by addition of gold(I). The emulsion was then heated to 60° C. and held at this temperature for 28 minutes with subsequent addition of 1-(3-acetamidophenyl)-5-mercaptotetrazole followed by addition of Lippmann bromide and followed by addition of Spectral Sensitizing dye B. Then the emulsion was cooled to 40° C.

Part 4.2: A portion of silver chloride Emulsion B was sensitized exactly as in Part 4.1.

Part 4.3: A portion of silver chloride Emulsion C was sensitized exactly as in Part 4.1.

Part 4.4: A portion of silver chloride Emulsion D was sensitized exactly as in Part 4.1.

Sensitometric Data are Summarized in Table IV

TABLE III

| Coating ID | mg $K_4Ru(CN)_6$/ Ag mole | mg $K_2IrCl_5$ (Tz)/ Ag mole | Optical Sensitivity HIRF $10^{-2}$ s–$10^{-4}$s Dmin + 1.3 | HIRF Dmin + 1.95 | LIRF 10 s–0.1 s Dmin + 1.3 | LIRF Dmin + 1.95 | Digital Sensitivity Speed @ Dmin + 1.9 | Contrast @ Dmin + 0.2 & Dmin + 1.8 |
|---|---|---|---|---|---|---|---|---|
| Part 3.1 | — | — | 37.6 | 45.9 | 3.7 | 3.4 | 45 | 1.329 |
| Part 3.2 | 16.54 | — | 37.5 | 42.9 | 3.9 | 3.2 | 68 | 1.382 |
| Part 3.3 | — | 0.16 | 16.1 | 26.5 | 2.0 | 2.8 | 72 | 1.607 |
| Part 3.4 | 16.54 | 0.16 | −3.7 | −1.7 | 0.9 | 0.7 | 108 | 1.875 |

TABLE IV

| Coating ID | mg $K_4Ru(CN)_6$/ Ag mole | mg $K_2IrCl_5$ (Tz)/ Ag mole | Optical Sensitivity HIRF $10^{-2}$ s–$10^{-4}$s Dmin + 1.3 | HIRF Dmin + 1.95 | LIRF 10 s–0.1 s Dmin + 1.3 | LIRF Dmin + 1.95 | Digital Sensitivity Speed @ Dmin + 1.9 | Contrast @ Dmin + 0.2 & Dmin + 1.8 |
|---|---|---|---|---|---|---|---|---|
| Part 4.1 | — | — | 55.8 | 59.8 | 12.4 | 14.9 | 21 | 1.245 |
| Part 4.2 | 16.54 | — | 45.7 | 50.5 | 10.4 | 9.5 | 32 | 1.513 |
| Part 4.3 | — | 0.16 | 27.6 | 37.2 | 3.1 | 3.1 | 46 | 1.546 |
| Part 4.4 | 16.54 | 0.16 | −0.2 | 5.6 | 1.0 | 1.5 | 98 | 2.109 |

The above results again demonstrate that the combination of dopants in accordance with the invention can essentially eliminate reciprocity failure for both relatively high and low intensity exposures. Also, significant increased speed and contrast are again exhibited for digital exposures in accordance with preferred embodiments of the invention.

Example 5

This example compares effects of $K_4Ru(CN)_6$ and $K_2IrCl_5$(5-Methyl-Tz) synergy on shoulder reciprocity failure. In each case, silver chloride cubic emulsions sensitized for red color record were used. The sensitization details are as follows:

Part 5.1: A portion of silver chloride Emulsion A was sensitized exactly as in Part 3.1.

Part 5.2: A portion of silver chloride Emulsion B was sensitized exactly as in Part 3.1.

Part 5.3: A portion of silver chloride Emulsion E was sensitized exactly as in Part 3.1.

Part 5.4: A portion of silver chloride Emulsion F was sensitized exactly as in Part 3.1.

Sensitometric Data are Summarized in Table V

TABLE V

| Coating ID | mg $K_4Ru(CN)_6$/ Ag mole | mg $K_2IrCl_5$(5-Methyl-Tz)/ Ag mole | Optical Sensitivity HIRF $10^{-2}$ s–$10^{-4}$s Dmin + 1.3 | HIRF Dmin + 1.95 | LIRF 10 s–0.1 s Dmin + 1.3 | LIRF Dmin + 1.95 | Digital Sensitivity Speed @ Dmin + 1.9 | Contrast @ Dmin = 0.2 & Dmin + 1.8 |
|---|---|---|---|---|---|---|---|---|
| Part 5.1 | — | — | 37.6 | 45.9 | 3.7 | 3.4 | 45 | 1.329 |
| Part 5.2 | 16.54 | — | 37.5 | 42.9 | 3.9 | 3.2 | 68 | 1.382 |
| Part 5.3 | — | 0.164 | 24.2 | 29.9 | 2.9 | 2.8 | 69 | 1.440 |
| Part 5.4 | 16.54 | 0.164 | −1.5 | 1.5 | 1.6 | 1.2 | 98 | 1.938 |

The above results again demonstrate that the combination of dopants in accordance with the invention can essentially eliminate reciprocity failure for both relatively high and low intensity exposures. Also, significant increased speed and contrast are again exhibited for digital exposures in accordance with preferred embodiments of the invention.

Example 6

This example compares effects of $K_4Ru(CN)_6$ and $K_2IrCl_5$(5-Methyl-Tz) synergy on shoulder reciprocity failure. In each case, silver chloride cubic emulsions sensitized for red color record were used. The sensitization details are as follows:

Part 6.1: A portion of silver chloride Emulsion A was sensitized exactly as in Part 4.1.

Part 6.2: A portion of silver chloride Emulsion B was sensitized exactly as in Part 4.1.

Part 6.3: A portion of silver chloride Emulsion E was sensitized exactly as in Part 4.1.

Part 6.4: A portion of silver chloride Emulsion F was sensitized exactly as in Part 4.1.

Sensitometric Data are Summarized in Table VI

TABLE VI

| Coating ID | mg $K_4Ru(CN)_6$/ Ag mole | mg $K_2IrCl_5$(5-Methyl-Tz)/ Ag mole | Optical Sensitivity HIRF $10^{-2}$ s–$10^{-4}$s Dmin + 1.3 | HIRF Dmin + 1.95 | LIRF 10 s–0.1 s Dmin + 1.3 | LIRF Dmin + 1.95 | Digital Sensitivity Speed @ Dmin + 1.9 | Contrast @ Dmin + 0.2 & Dmin + 1.8 |
|---|---|---|---|---|---|---|---|---|
| Part 6.1 | — | — | 55.8 | 59.8 | 12.4 | 14.9 | 21 | 1.245 |
| Part 6.2 | 16.54 | — | 45.7 | 50.5 | 10.4 | 9.5 | 32 | 1.311 |
| Part 6.3 | — | 0.164 | 32.5 | 45.8 | 9.6 | 8.2 | 41 | 1.315 |
| Part 6.4 | 16.54 | 0.164 | 12.8 | 31.3 | −1.8 | 1.1 | 72 | 1.738 |

The above results again demonstrate significantly decreased reciprocity failure for both relatively high and low intensity exposures for emulsions comprising a combination of dopants in accordance with the invention. Also, significant increased speed and contrast are exhibited for digital exposures in accordance with preferred embodiments of the invention.

Example 7

This example compares effects of $K_4Ru(CN)_6$ and $K_2IrCl_5$(5-Methyl-Tz) synergy on shoulder reciprocity failure. In each case, silver chloride cubic emulsions sensitized for green color record were used. The sensitization details are as follows:

Part 7.1: A portion of silver chloride Emulsion G was optimally sensitized by the addition of gold sulfide. The emulsion was then heated to 55° C. and held at this temperature for 33 minutes with subsequent addition Lippmann bromide, followed by addition of Spectral Sensitizing Dye C followed by addition of 1-(3-acetamidophenyl)-5-mercaptotetrazole. Then the emulsion was cooled to 40° C.

Part 7.2: A portion of silver chloride Emulsion H was sensitized exactly as in Part 7.1.

Part 7.3: A portion of silver chloride Emulsion I was sensitized exactly as in Part 7.1.

Part 7.4: A portion of silver chloride Emulsion J was sensitized exactly as in Part 7.1.

Sensitometric Data are Summarized in Table VII

TABLE VII

| Coating ID | mg $K_4Ru(CN)_6$/ Ag mole | mg $K_2IrCl_5$(5-Methyl-Tz)/ Ag mole | Optical Sensitivity HIRF $10^{-3}$ s–$10^{-5}$s Dmin + 1.3 | HIRF Dmin + 1.95 | LIRF 1 s–$10^{-2}$ s Dmin + 1.3 | LIRF Dmin + 1.95 | Laser Sensitivity Speed @ Dmin + 1.9 | Contrast @ Dmin + 0.2 & Dmin + 1.8 |
|---|---|---|---|---|---|---|---|---|
| Part 7.1 | — | — | 39.8 | 61.8 | 14.2 | 13.8 | 40 | 1.709 |
| Part 7.2 | 16.54 | — | 31.6 | 56 | 9.4 | 11.2 | 58 | 1.892 |
| Part 7.3 | — | 0.1656 | 7.2 | 24.1 | 7.6 | 8.8 | 62 | 1.911 |
| Part 7.4 | 16.54 | 0.1656 | 2.4 | 5.3 | 1.1 | −0.5 | 96 | 2.354 |

The above results again demonstrate that the combination of dopants in accordance with the invention can essentially eliminate reciprocity failure for both relatively high and low intensity exposures. Also, significant increased speed and contrast are again exhibited for digital exposures in accordance with preferred embodiments of the invention.

Example 8

This example compares effects of $K_4Ru(CN)_6$ and $K_2IrCl_5$(5-Methyl-Tz) synergy on shoulder reciprocity failure. In each case, silver chloride cubic emulsions sensitized for green color record were used. The sensitization details are as follows:

Part 8.1: A portion of silver chloride Emulsion G was sensitized exactly as in Part 7.1.

Part 8.2: A portion of silver chloride Emulsion H was sensitized exactly as in Part 7.1.

Part 8.3: A portion of silver chloride Emulsion K was sensitized exactly as in Part 7.1.

Part 8.4: A portion of silver chloride Emulsion L was sensitized exactly as in Part 7.1 .

Sensitometric Data are Summarized in Table VIII

TABLE VIII

| Coating ID | mg $K_4Ru(CN)_6$/ Ag mole | mg $K_2IrCl_5$(5-Methyl-Tz)/ Ag mole | Optical Sensitivity HIRF $10^{-3}$ s–$10^{-5}$s Dmin + 1.3 | HIRF Dmin + 1.95 | LIRF 1 s–$10^{-2}$ s Dmin + 1.3 | LIRF Dmin + 1.95 | Digital Sensitivity Speed @ Dmin + 1.9 | Contrast @ Dmin + 0.2 & Dmin + 1.8 |
|---|---|---|---|---|---|---|---|---|
| Part 8.1 | — | — | 39.8 | 61.8 | 14.2 | 13.8 | 40 | 1.709 |
| Part 8.2 | 16.54 | — | 31.6 | 56 | 9.4 | 11.2 | 58 | 1.892 |
| Part 8.3 | — | 0.3312 | 3.2 | 6.2 | 4.9 | 7.1 | 64 | 1.931 |
| Part 8.4 | 16.54 | 0.3312 | 1.1 | 1.6 | −0.9 | —0.5 | 102 | 2.426 |

The above results again demonstrate that the combination of dopants in accordance with the invention can essentially eliminate reciprocity failure for both relatively high and low intensity exposures. Also, significant increased speed and contrast are exhibited for digital exposures in accordance with preferred embodiments of the invention.

Example 9

This example compares effects of $K_4Ru(CN)_6$ and $K_2IrCl_5$(5-Methyl-Tz) synergy on shoulder reciprocity failure. In each case, silver chloride cubic emulsions sensitized for green color record were used. The sensitization details are as follows:

Part 9.1: A portion of silver chloride Emulsion G was optimally sensitized by the addition of Spectral Sensitizing Dye C followed by the optimum amount of gold sulfide. The emulsion was then heated to 60° C. and held at this temperature for 34 minutes. Then the emulsion was cooled to 40° C. with subsequent addition soluble bromide, followed by addition of 1-(3-acetamidophenyl)-5-mercaptotetrazole.

Part 9.2: A portion of silver chloride Emulsion H was sensitized exactly as in Part 9.1.

Part 9.3: A portion of silver chloride Emulsion I was sensitized exactly as in Part 9.1.

Part 9.4: A portion of silver chloride Emulsion J was sensitized exactly as in Part 9.1.

Sensitometric Data are Summarized in Table IX

TABLE IX

| Coating ID | mg $K_4Ru(CN)_6$/ Ag mole | mg $K_2IrCl_5$(5-Methyl-Tz)/ Ag mole | Optical Sensitivity HIRF $10^{-3}$ s–$10^{-5}$s Dmin + 1.3 | Optical Sensitivity HIRF $10^{-3}$ s–$10^{-5}$s Dmin + 1.95 | Optical Sensitivity LIRF 1 s–$10^{-2}$ s Dmin + 1.3 | Optical Sensitivity LIRF 1 s–$10^{-2}$ s Dmin + 1.95 | Digital Sensitivity Speed @ Dmin + 1.9 | Digital Sensitivity Contrast @ Dmin + 0.2 & Dmin + 1.8 |
|---|---|---|---|---|---|---|---|---|
| Part 9.1 | — | — | 32.6 | 48.6 | 14.5 | 14.9 | 60 | 1.880 |
| Part 9.2 | 16.54 | — | 32.4 | 45.6 | 7.2 | 11.1 | 74 | 2.114 |
| Part 9.3 | — | 0.1656 | 8.3 | 18 | 7.7 | 9.4 | 80 | 2.160 |
| Part 9.4 | 16.54 | 0.1656 | 3.2 | 4.7 | 0.5 | 1.8 | 114 | 2.620 |

The above results again demonstrate that the combination of dopants in accordance with the invention can essentially eliminate reciprocity failure for both relatively high and low intensity exposures. Also, significant increased speed and contrast are exhibited for digital exposures in accordance with preferred embodiments of the invention.

Example 10

This example compares effects of $K_4Ru(CN)_6$ and $K_2IrCl_5$(5-Methyl-Tz) synergy on shoulder reciprocity failure. In each case, silver chloride cubic emulsions sensitized for green color record were used. The sensitization details are as follows:

Part 10.1: A portion of silver chloride Emulsion G was sensitized exactly as in Part 9.1.

Part 10.2: A portion of silver chloride Emulsion H was sensitized exactly as in Part 9.1.

Part 10.3: A portion of silver chloride Emulsion K was sensitized exactly as in Part 9.1.

Part 10.4: A portion of silver chloride Emulsion L was sensitized exactly as in Part 9.1.

Sensitometric Data are Summarized in Table X

TABLE X

| Coating ID | mg $K_4Ru(CN)_6$/ Ag mole | mg $K_2IrCl_5$(5-Methyl-Tz)/ Ag mole | Optical Sensitivity HIRF $10^{-3}$ s–$10^{-5}$s Dmin + 1.3 | Optical Sensitivity HIRF $10^{-3}$ s–$10^{-5}$s Dmin + 1.95 | Optical Sensitivity LIRF 1 s–$10^{-2}$ s Dmin + 1.3 | Optical Sensitivity LIRF 1 s–$10^{-2}$ s Dmin + 1.95 | Digital Sensitivity Speed @ Dmin + 1.9 | Digital Sensitivity Contrast @ Dmin + 0.2 & Dmin + 1.8 |
|---|---|---|---|---|---|---|---|---|
| Part 10.1 | — | — | 32.6 | 48.6 | 14.5 | 14.9 | 60 | 1.880 |
| Part 10.2 | 16.54 | — | 32.4 | 45.6 | 7.2 | 11.1 | 74 | 2.114 |
| Part 10.3 | — | 0.3312 | 4.5 | 7.0 | 4.8 | 7.1 | 82 | 2.423 |
| Part 10.4 | 16.54 | 0.3312 | 1.3 | 1.9 | 1.4 | 0.3 | 118 | 2.648 |

The above results again demonstrate that the combination of dopants in accordance with the invention can essentially eliminate reciprocity failure for both relatively high and low intensity exposures. Also, significant increased speed and contrast are exhibited for digital exposures in accordance with preferred embodiments of the invention.

It is specifically contemplated that emulsions in accordance with the invention may be sensitized with red, green, and blue sensitizing dyes and be incorporated in a color paper format as described in Example 4 of U.S. Pat. No. 5,783,373, incorporated by reference above.

The invention has been described in detail with particular reference to preferred embodiments thereof, but it will be understood that variations and modifications can be effected within the spirit and scope of the invention.

What is claimed is:

1. A radiation-sensitive emulsion comprised of silver halide grains (a) containing greater than 50 mole percent chloride, based on silver, (b) having greater than 50 percent of their surface area provided by {100} crystal faces, and (c) having a central portion accounting for from 95 to 99 percent of total silver and containing two dopants selected to satisfy each of the following class requirements:

(i) a hexacoordination metal complex which satisfies the formula:

$$[ML_6]^n \quad \text{(I)}$$

wherein n is zero, −1, −2, −3 or −4;

M is a filled frontier orbital polyvalent metal ion, other than iridium; and $L_6$ represents bridging ligands which can be independently selected, provided that at least four of the ligands are anionic ligands, and at least one of the ligands is a cyano ligand or a ligand more electronegative than a cyano ligand; and (ii) an iridium coordination complex containing a thiazole or substituted thiazole ligand.

2. A radiation-sensitive emulsion according to claim 1, wherein the iridium coordination complex of class (ii) satisfies the formula:

$$[IrL^1{}_6]^{n'} \quad \text{(II)}$$

wherein n' is zero, −1, −2, −3 or −4; and $L^1{}_6$ represents six bridging ligands which can be independently selected, provided that at least four of the ligands are anionic ligands, each of the ligands is more electropositive than a cyano ligand, and at least one of the ligands comprises a thiazole or substituted thiazole ligand.

3. A radiation-sensitive emulsion according to claim 2 wherein at least one of the ligands of the class (ii) dopant is a halide ligand.

4. A radiation-sensitive emulsion according to claim 2 wherein at least four of the ligands of the class (ii) dopant are halide ligands.

5. A radiation-sensitive emulsion according to claim 2 wherein at least one of the ligands of the class (ii) dopant is a chloride ligand.

6. A radiation-sensitive emulsion according to claim 2 wherein at least four of the ligands of the class (ii) dopant are chloride ligands.

7. A radiation-sensitive emulsion according to claim 2 wherein M represents an $Fe^{+2}$, $Ru^{+2}$, $Os^{+2}$, $Co^{+3}$, $Rh^{+3}$, $Pd^{+4}$, or $Pt^{+4}$ ion.

8. A radiation-sensitive emulsion according to claim 2 wherein M represents an iron, ruthenium or osmium ion.

9. A radiation-sensitive emulsion according to claim 2 wherein M represents a ruthenium ion.

10. A radiation-sensitive emulsion according to claim 2 wherein the silver halide grains contain at least 70 mole percent chloride, based on silver.

11. A radiation-sensitive emulsion according to claim 2 wherein the silver halide grains contain less than 5 mole percent iodide, based on silver.

12. A radiation-sensitive emulsion according to claim 11 wherein the silver halide grains contain less than 2 mole percent iodide, based on silver.

13. A radiation-sensitive emulsion according to claim 2 further comprising a gelatino-peptizer containing at least 30 micromoles of methionine per gram.

14. A radiation-sensitive emulsion according to claim 13 wherein at least 50 wt percent of the gelatino-peptizer present contains at least 30 micromoles of methionine per gram.

15. A radiation-sensitive emulsion according to claim 2 wherein the class (i) dopant is located within the central portion of grains in an interior region surrounding at least 50 percent of the total silver forming the grains and is present in a concentration of from $10^{-8}$ to $10^{-3}$ mole per mole of silver, and the class (ii) dopant is located within the central portion of the grains in a sub-surface shell region surrounding at least 50 percent of the total silver forming the grains and is present in a concentration of from $10^{-9}$ to $10^{-4}$ mole per mole of silver.

16. A radiation-sensitive emulsion according to claim 2 wherein each of the bridging ligands of the class (i) dopant are at least as electronegative as cyano ligands.

17. A radiation-sensitive emulsion according to claim 16 wherein the class (i) dopant is present in a concentration of from $10^{-6}$ to $5\times10^{-4}$ mole per silver mole.

18. A radiation-sensitive emulsion according to claim 2 wherein the (ii) dopant is an iridium coordination complex containing five halide ligands.

19. A radiation-sensitive emulsion according to claim 2 wherein the class (ii) dopant is present in a concentration from $10^{-8}$ to $10^{-5}$ mole per silver mole.

20. A radiation-sensitive emulsion according to claim 1 wherein each of the bridging ligands of the class (i) dopant are at least as electronegative as cyano ligands and M represents a ruthenium ion, and the class (ii) dopant is a iridium hexacoordination complex containing five halide ligands.

21. A radiation-sensitive emulsion according to claim 20 wherein the class (ii) dopant is an iridium coordination complex containing five halide ligands and a thiazole or 5-methyl thiazole ligand.

22. An electronic printing method which comprises subjecting a radiation sensitive silver halide emulsion layer of a recording element to actinic radiation of at least $10^{-4}$ ergs/cm$^2$ for up to 100$\mu$ seconds duration in a pixel-by-pixel mode, wherein the silver halide emulsion layer is comprised of silver halide grains (a) containing greater than 50 mole percent chloride, based on silver, (b) having greater than 50 percent of their surface area provided by {100} crystal faces, and (c) having a central portion accounting for from 95 to 99 percent of total silver and containing two dopants selected to satisfy each of the following class requirements:

(i) a hexacoordination metal complex which satisfies the formula:

$$[ML_6]^n \quad \text{(I)}$$

wherein n is zero, −1, −2, −3 or −4;

M is a filled frontier orbital polyvalent metal ion, other than iridium; and $L_6$ represents bridging ligands which can be independently selected, provided that at least four of the ligands are anionic ligands, and at least one of the ligands is a cyano ligand or a ligand more electronegative than a cyano ligand; and (ii) an iridium coordination complex containing a thiazole or substituted thiazole ligand.

23. A method according to claim 22 wherein the pixels are exposed to actinic radiation of about $10^{-3}$ ergs/cm$^2$ to $10^2$ ergs/cm$^2$.

24. A method according to claim 22 wherein the exposure is up to 10$\mu$ seconds.

25. A method according to claim 22 wherein the duration of the exposure is up to 0.5$\mu$ seconds.

26. A method according to claim 22 wherein the duration of the exposure is up to 0.05$\mu$ seconds.

27. A method according to claim 22 wherein the source of actinic radiation is a light emitting diode.

28. A method according to claim 22 wherein the source of actinic radiation is a laser.

29. A method according to claim 22 wherein the recording element contains a yellow, magenta or cyan dye-forming coupler and is exposed to a portion of the infrared region of the spectrum by a laser source to produce a dye image on processing.

* * * * *